United States Patent [19]

Schilder

[11] Patent Number: 4,545,734

[45] Date of Patent: Oct. 8, 1985

[54] AXIAL FLOW MACHINE, PARTICULARLY A BLOWER, WITH ADJUSTABLE ROTOR BLADES

[75] Inventor: Hans Schilder, Zweibrücken, Fed. Rep. of Germany

[73] Assignee: J. M. Voith GmbH, Fed. Rep. of Germany

[21] Appl. No.: 514,960

[22] Filed: Jul. 18, 1983

[30] Foreign Application Priority Data

Jul. 20, 1982 [DE] Fed. Rep. of Germany ..... 3227071

[51] Int. Cl.[4] ..... F04D 29/06

[52] U.S. Cl. ..... 416/146 A; 416/167; 416/174

[58] Field of Search ..... 416/167, 174, 146 R, 416/146 A

[56] References Cited

U.S. PATENT DOCUMENTS

| | | | |
|---|---|---|---|
| 1,510,436 | 9/1924 | Englesson | 416/174 X |
| 2,479,668 | 8/1949 | Brandon et al. | 416/167 |
| 2,636,714 | 4/1953 | Willi . | |
| 2,844,303 | 7/1958 | Kristiansen | 416/167 |
| 3,169,582 | 2/1965 | Schilder et al. | 416/167 |
| 3,245,497 | 4/1966 | Yokoi | 416/174 X |
| 3,367,424 | 2/1968 | Fukasu et al. | 416/157 X |
| 3,790,301 | 2/1974 | Pedersen et al. | 416/108 |
| 3,967,916 | 7/1976 | Chittom | 416/167 |
| 4,046,486 | 9/1977 | Kolb | 416/146 A X |
| 4,364,708 | 12/1982 | David | 416/167 X |

FOREIGN PATENT DOCUMENTS

| | | | |
|---|---|---|---|
| 505927 | 9/1954 | Canada | 416/146 A |
| 422201 | 11/1925 | Fed. Rep. of Germany | 416/174 |
| 2241768 | 3/1974 | Fed. Rep. of Germany | 416/167 |
| 675767 | 7/1952 | United Kingdom | 416/174 |
| 1512559 | 6/1978 | United Kingdom | 416/146 A |

*Primary Examiner*—Everette A. Powell, Jr.

*Attorney, Agent, or Firm*—Ostrolenk, Faber, Gerb & Soffen

[57] ABSTRACT

An axial flow machine particularly a blower, has rotor blades external to a housing and each blade is supported by a respective strut which is rotatable about its respective strut axis to adjust the orientation of the blades. A respective crank-like swing lever attached to each strut is movable to rotate the strut. Each swing lever has a slide block at the end thereof which is carried in the annular peripheral groove of an axially movable adjustment part. As the adjustment part is displaced axially, the swing levers rotate in their slide blocks. The invention is concerned with lubricating the rotation of the swing levers in the slide blocks. The adjustment part is at least partly inundated by an oil supply held in the housing. The adjustment part is scoop shaped. The rim of the adjustment part includes an annular peripheral wall on the exterior of which the peripheral groove is defined. Oil flow passages through the peripheral wall transmit oil into the annular groove at the swing levers for lubricating the slide blocks. Each swing lever has a collecting chamber and a communicating passage between the collecting chamber and the surface of the swing lever inside the slide block. The housing of the machine may be oriented with its axis horizontal or vertical and the adjustment part has appropriate walls and connecting tubes for assuring flow of lubrication through the peripheral wall and to the swing lever for the slide block and also for lubricating the groove for the slide blocks.

12 Claims, 5 Drawing Figures

AXIAL FLOW MACHINE, PARTICULARLY A BLOWER, WITH ADJUSTABLE ROTOR BLADES

BACKGROUND OF THE INVENTION

The present invention concerns an axial flow machine or blower having a rotor with adjustable blades, and particularly relates to the lubrication of the pathway of rotation of the struts for the rotor blades.

An axial flow machine, and particularly a blower, comprises a closed housing and rotor blades supported externally of the housing for being rotated together with the housing. The blades are supported by respective struts which extend into the housing. The orientation of the rotor blades with respect to the housing is adjusted by rotation of the respective struts. The struts are adjusted in their rotation by an axially displaceable adjustment part in the housing with which each of the struts is in engagement, such that axial displacement of the adjustment part causes rotation of the struts and of the blades for facilitating simultaneous adjustment of the orientation of all of the blades.

To each of the struts is attached a swing lever pin that is offset from the strut in the manner of a crank. Each swing lever pin is carried in a respective slide block, with respect to which the pin is rotatable. The slide blocks are in turn received in a peripheral annular groove in the adjustment part. The axial displacement of the adjustment part moves the slide blocks, causing the struts and blades to rotate to different orientations.

Within the enclosed housing, the struts are supported not only at the slide blocks, but at one or more support bearings along the length of the strut, which permit rotation of the struts to adjust the blade orientations.

Such an axial flow machine or blower is known from U.S. Pat. No. 4,046,486. In that machine, a ring of oil is established on the inner circumference of the housing during operation. In this way, satisfactory lubrication of the strut bearings is obtained. However, the lubrication of the slide blocks in the groove of the adjustment part is unsatisfactory. These blocks have oil flow over them only at irregular intervals, namely the oil which collects in the bottom of the housing only when the axial blower is shut off.

SUMMARY OF THE INVENTION

The object of the present invention is to assure lubrication of the slide blocks in an axial flow machine, and particularly a blower, of the aforementioned type, while at the same time supplementing a supply of lubricant associated with each slide block each time the machine is started.

This object is achieved by appropriate shaping and arrangement of the axially displaceable adjustment part. The adjustment part is disposed in the center of the rotationally symmetric housing. The adjustment part is itself a generally scoop-shaped member of rotational symmetry. The adjustment part has a rim, and the groove in which the slide blocks are received is defined around the rim. There is a pool of oil in the housing which is deep enough that when the axial flow machine has stopped, the scoop member is at least in part inundated or dipped into the oil which collects toward the bottom of the housing. Oil collected at the rim of the adjustment part radially inwardly of the annular groove containing the slide blocks passes along oil outlet paths into the groove and to the radially inward faces of the swing lever pins and of the side blocks in the groove.

Each of the swing lever pins has a small oil collection chamber in which oil is received. There is a channel communicating from the collection chamber to the surface between the swing lever pin and its respective slide block to lubricate the rotation of the pin in the slide block and thus rotation of the strut and the blade. Upon start-up of the axial flow machine, the oil taken up is distributed within the adjustment part which is in the shape of a ring. In each case, a portion of the oil passes from this ring to the corresponding receiving container in the corresponding swing lever pin and from there to the lubrication pumps of the individual slide blocks.

In various embodiments of the invention, the axial flow machine may be oriented with the axis of the housing either generally horizontal or generally vertical. In the embodiment with the axis horizontal, i.e. with the housing upright. The radial interior, i.e. the bottom, of the annular groove has bore holes through it which serve as oil outlet paths for oil that is within the central scoop portion of the adjustment part to move out to the annular groove.

In one embodiment where the housing is arranged with its axis vertical, as when the housing is supported from below, the adjustment part is a scoopshaped member, which opens upwardly toward the top of the housing. An oil passageway passes through the scoop member and communicates into the housing beneath the adjustment part. There are bore holes through the peripheral wall of the rim at the annular periphery of the adjustment part which communicate the oil inside the scoop-shaped adjustment part to the annular groove.

In an alternate embodiment where the housing axis is vertical, as when the housing is suspended from above, the adjustment part is developed as a downwardly open scoop-shaped member. Again, the peripheral wall that defines the radially inward side of the annular groove that receives the slide blocks and the swing lever pins has bore holes through it to serve as oil outlet paths. In this embodiment, the scoop-shaped adjustment part has a bottom, annular wall section which tapers conically narrower moving downwardly in the housing and this wall section defines an open space communicating into the interior of the scoop-shaped member.

In an alternate arrangement of the previous embodiment, within the downwardly open, scoop-shaped adjustment part, there is an additional annular wall which is coaxial with the adjustment part and which extends up inside the annular peripheral wall of the adjustment part and terminates shortly below the scoop-shaped adjustment part itself. At least one tubular connection extends between the interior of the additional coaxial wall and the annular space external thereto, between the additional annular wall and the peripheral wall of the adjustment part.

The slide block is seated on the narrowed end of the swing lever pin. Around the narrowed end of the swing lever pin and radially outward of the slide block, a friction reducing annular disc is disposed around the swing lever pin. The slide block rests against the disc and the disc rests against the pin. The disc helps rotation of the pin with respect to the slide block and also prevents oil delivered to the surface between the pin and the slide block from undesirably flowing away.

BRIEF DESCRIPTION OF THE DRAWINGS

Four illustrative embodiments of the invention will be described in further detail below with reference to the accompanying drawing, which are diagrammatic cross-sections.

DESCRIPTION OF THE PREFERRED EMBODIMENTS

Figure 1:
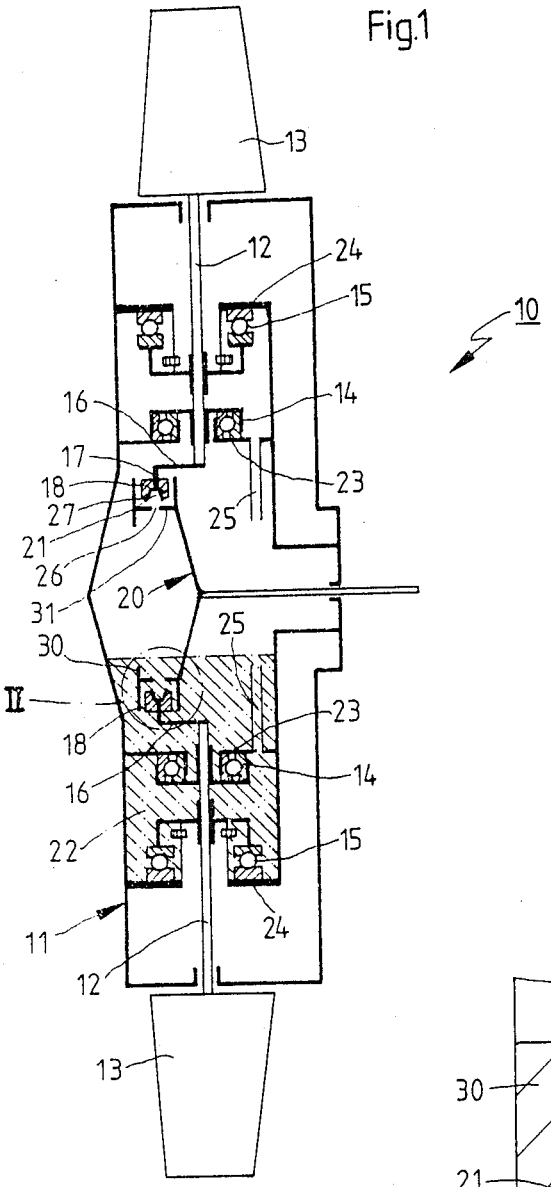
FIG. 1 shows an axial blower with a horizontally extending axis of the machine, the first embodiment of the invention.

Referring to FIG. 1, the axial blower 10 has a rotationally symmetric closed housing 11. The housing is connected to a motor (not shown) at the right of the housing in FIG. 1. The housing and everything inside it are all rotated together by the motor. Within the housing, there are a plurality of radially extending struts 12 arrayed around the housing. Each strut supports a blade external to the housing. Each strut 12 for supporting a respective adjustable rotor blade 13 is mounted by respective radially inward and radially outward ball bearings 14 and 15, which pass around that strut and guide its rotation with respect to the housing 11. Each strut 12 is connected to one raceway of each of the respective ball bearings 14, 15. The other raceways of the bearings 14, 15 are secured to the housing 11.

At its end facing away from its blade, each strut 12 has a single-arm swing lever 16. At its free end, each lever 16 carries a pin 17 which extends parallel to and is offset from the axis of the strut. The lever 16 and its pin 17 together function as a crank. The pin 17 is moved by the below-described adjustment part 20 to rotate the strut 12 to reorient the blade 13.

Figure 2:
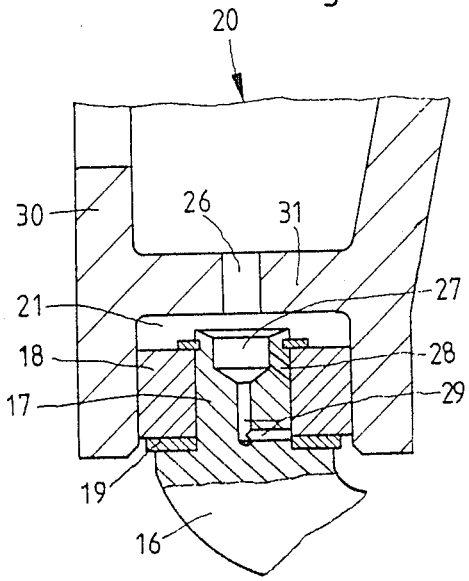
FIG. 2 is an enlarged detail of area II of FIG. 1, showing a slide block mounted.on the swing lever side in engagement with an adjustment part for the adjustment of the rotor blades.

Referring to FIG. 2, a slide block 18 is rotatably mounted on each of the swing lever pins 17. The slide block has a radially outward face, which rests against the swing lever 16 through the interposed annular disc 19 which is radially outward of the slide block.

An axially displaceable adjustment part 20 is arranged co-axially within the housing 11. It includes an operating rod which projects out of the housing by which the adjustment part is axially displaced. The adjustment part has an annular groove 21 on its periphery. The slide blocks 18 at the swing levers 16 project into the annular groove 21 and engage its lateral, axial side walls so that all rotor blades 13 are adjusted synchronously upon axial displacement of the adjustment part 20.

An oil supply 22 is contained within the housing 11. This oil supply is indicated in dash-dot lines in the drawing. The pool of oil in the supply is high enough to cover the below-described peripheral wall 31 of the adjustment part. When the axial blower 10 is started, the oil is distributed in the form of two rings on the inside on the co-axially extending intermediate walls 23 and 24 of the housing 11 which support the respective ball bearings 14 and 15 for each of the struts 12. To the inner intermediate wall 23 there are fastened a uniformly spaced array of small tubes 25 which extend radially toward the axis of the machine. Upon the starting of the axial blower 10, these tubes have the purpose of forming an oil ring in the region of each intermediate wall 23 and 24, respectively. On the other hand, when the blower is shut off, the oil can flow down and collect in the housing 11. The individual hollow spaces of the housing 11 are vented in order to permit the distribution and collecting respectively of the oil within the housing 11 which takes place in accordance with the condition of operation of the axial blower 10. In this way, lubrication of the ball bearings 14 and 15 is assured.

The oil further serves the purpose of lubricating the slide blocks 18 in the annular groove 21. For this purpose, the adjustment part 20 which is arranged in the center of the housing is developed as a scoop member of rotational symmetry which is inundated, at least in part, by oil which collects in the housing 11 when the axial blower is stopped. From the adjustment part 20, and particularly from the peripheral wall 31 at the rim of the part 20, radially outwardly extending oil outlet paths 26 lead to the peripheral groove and to the swing-lever pins 17. Each of the pins 17 is provided with a collection container 27 for the oil, and that container is open toward the center of the housing. From the collection container 27, channels 28, 29 lead to lubricating points of the slide block 18 on the surface of the swing lever pins 17.

When the axial blower 10 is started, the oil taken up by the adjustment part 20 is distributed also in the form of a ring within that part. Some of the oil flows through the oil outlet paths 26 into the receiving containers 27, through the channels 28 and 29 to the lubricating points of the corresponding slide blocks 18. The flow off of the oil is prevented by the friction-reducing annular disks 19 between the slide blocks 18 and the corresponding swing levers 16 radially outwardly of the slide blocks.

In order that the association of the collecting containers 27 with the corresponding oil outlet paths 26 is retained, at least one slide block 18 can be connected, in a manner not shown in the drawing, in form-locked fashion with the adjustment part 20 by means of a pin. The adjustment part 20 can also be so guided by means of connecting rods (not shown) that a turning movement is imposed upon it during its axial displacement.

The construction of the axial blower 10 and the manner in which it is lubricated with oil as described up to now is the same in all of the embodiments described below. The differences in connection with the supply of oil of the adjustment part 20 is only a function of the installation position of the axial blower 10.

In the first embodiment of the axial blower 10, shown in FIGS. 1 and 2, wherein the axis of the blower is horizontal, the adjustment part 20 is developed in scoop or dish shape and has a free peripheral rim 30 which is on the concavely curved side of the body of the part 20 and extends inward toward the axis of the blower. Upon start-up of the blower, the free rim 30 maintains the oil ring on the peripheral wall 31 at the rim of the adjustment part 20. The wall 31 forms the bottom of the annular groove 21 which receives the slide blocks 18. Furthermore, radially extending holes 26 in the peripheral wall 31 serve as oil outlet paths.

Figure 3:
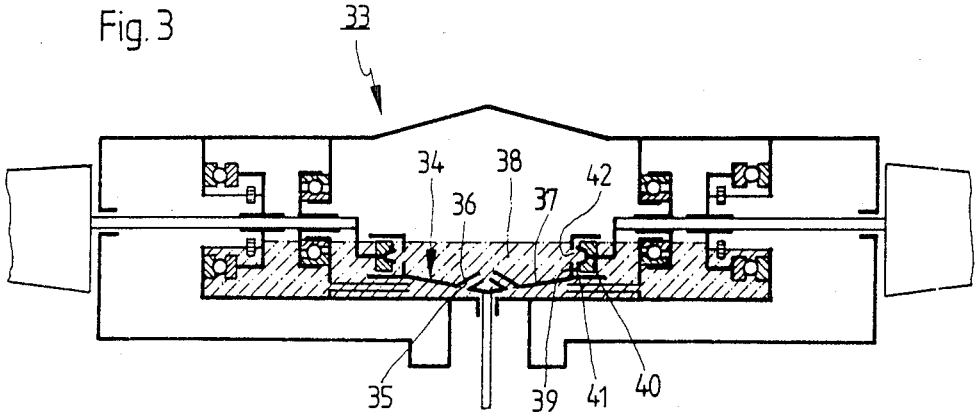
FIG. 3 shows an axial blower of the erect type, the second embodiment.

In the second embodiment, shown in FIG. 3, the axial blower 33 is arranged upright, i.e. the drive motor (not shown) or a support for the blower is located below the blower. With this arrangement, the adjustment part 34 is also developed as a scoop-shaped or dish-shaped body whose concave side is open toward the top of the housing. The part 34 is provided with an oil passage 35 on the bottom. This oil passage is defined by two small tubes 36 which extend obliquely and radially toward the center of the adjustment part, and the bores of the tubes pass through the bottom 37 of the adjustment part 34. In a variant (not shown) of the embodiment described, it is also sufficient for this purpose to provide at least one bore hole close to the axis in the bottom 37 of the adjustment part 34. In this way, when the blower 33 is stationary, the oil 38 can flow (dash-dot lines) into the adjustment part 34.

The annular peripheral wall 39 of the adjustment part 34 forms the bottom of the groove 41 which receives the slide blocks 40. This wall 39 has bore holes associated with the slide blocks 40 which serve as oil outlet paths 42.

Figure 4:
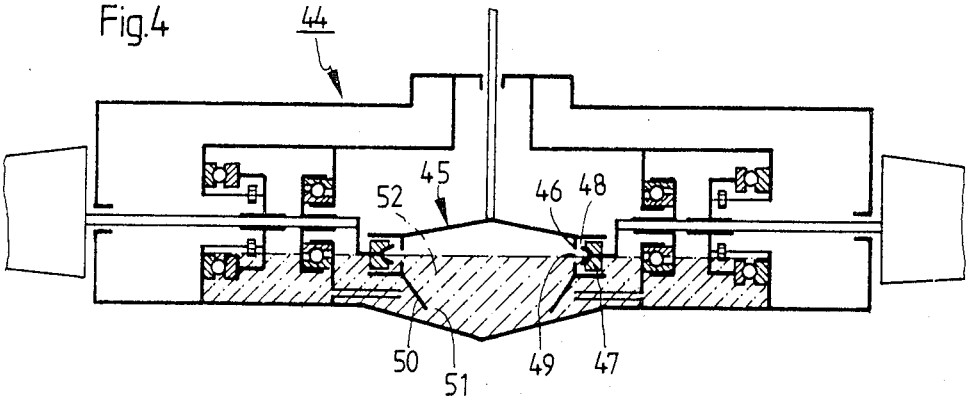
FIG. 4 shows an axial blower of the suspended type, the third embodiment.

In the third embodiment, shown in FIG. 4, the axial blower 44 is arranged suspended below the drive motor (not shown) or a support. The adjustment part 45 is developed as a now inverted scoop-shaped or dish-shaped body whose concave side is open toward the bottom of the housing. The section 46 of its bottom side peripheral wall provides the bottom for the annular groove 48, which receives the slide blocks 47. Furthermore, the wall section 46 has holes 49 which serve as oil outlet paths which are associated with the slide blocks 47. The wall section 50 of the adjustment part 45 tapers in and extends down from the bottom of the adjustment part and is tapered conically toward the opening 51. As a result of this development, the oil 52 can, on the one hand, pass unimpeded into the adjustment part 45 when the axial blower 44 is stationary. On the other hand, when the axial blower 44 is operating, flow of oil from the adjustment part 45 is possible only through the oil outlet paths 49.

Figure 5:
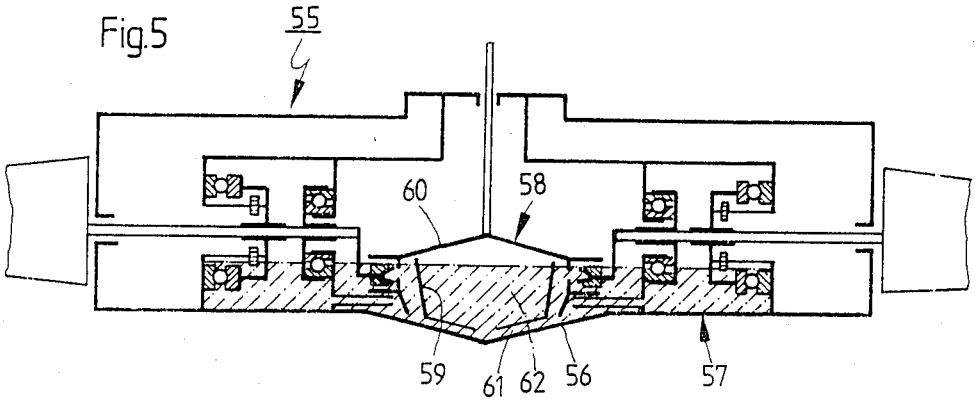
FIG. 5 shows another axial blower, also of the suspended type, the fourth embodiment.

In the fourth embodiment, shown in FIG. 5, the axial blower 55 is also arranged suspended. A coaxially arranged wall 59 extends into the interior of the adjustment part 58 and extends from the bottom end wall 56 of the housing 57. The wall 59 widens conically in the upward direction and terminates just below the body 60 of the adjustment part 58. On the side of its end wall, the wall 59 is passed through by two small tubes 61 which extend radially to the axis of the machine. This embodiment assures that when the adjustment part 58 is lifted relatively far from the underlying housing end wall 56, and there is possibly a greatly reduced supply of oil 62, a sufficient quantity of oil still flows to the adjustment part upon the start of the axial blower 55.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. An axial flow machine, comprising:

a closed housing adapted for containing an oil supply and rotatable about an axis;

a plurality of rotor blades located outside and arrayed around the housing and the axis and a respective strut for supporting each blade and the strut extending from the blade into the housing toward the the axis; the struts and blades rotating with the housing;

a respective swing lever attached to each strut; the swing lever being offset from the strut and being movable axially of the housing for rotating the strut about the axis of the strut, for adjusting the orientation of the blade that is supported on the strut, with respect to the housing;

a respective slide block located on the swing lever, and the swing lever including a pin rotatable in and with respect to the slide block therefore, each swing lever pin having a surface inside the respective slide block;

an adjustment part in the housing and rotatable therewith; the adjustment part having a solid body of rotational symmetry and including a rim having an annular peripheral groove therearound and a side which is radially inward from the annular groove; the slide blocks of the swing levers being disposed in the groove; each swing lever pin having a side facing into the groove; the adjustment part being displaceable axially in the housing for displacing the slide blocks axially for reorienting the blades;

the adjustment part being so placed in the housing and the housing being so shaped for holding the oil supply that when rotation of the rotor is stopped, the side of the adjustment part which is radially inward from the annular groove is at least partially covered by the oil in the oil supply;

the adjustment part having oil outlets defined therein for communicating from the side of the rim of the adjustment part which is radially inward of the annular groove and through the rim of the adjustment part into the annular groove for delivering oil to the swing lever pins and slide blocks in the annular groove;

the swing lever pins having oil transmitting means defined therein for transmitting oil from the side of each swing lever pin facing into the groove to the surface of the swing lever pin that is inside the respective slide block for lubricating the rotation of the swing lever pin in its slide block.

2. The machine of claim 1, wherein the oil transmitting means comprises a collection container defined in the swing lever pin, which faces into the groove, and further comprises a channel defined in the swing lever pin and communicating from the collection container through the swing lever pin to the exterior surface of the swing lever pin inside the slide block.

3. The machine of claim 1, wherein the adjustment part is generally scoop shaped, with a concave side; the rim being defined at the concave side of the adjustment part.

4. The machine of claim 3, wherein the axis is at least approximately horizontal; the rim also including an annular face rim which is spaced from the body of the adjustment part and which also extends a short distance radially inward toward the axis; the rim of the adjustment part including a peripheral wall which joins the free rim and the body of the adjustment part; the peripheral wall defining the bottom of the groove; the oil outlets communicating through the peripheral wall.

5. The machine of claim 3, wherein the axis of the machine is at least approximately vertical; the concave side of the adjustment part opening toward the top of the housing; an oil passage leading through the body of the adjustment part; the rim of the adjustment part including a peripheral wall defining the bottom of the groove; the oil outlets communicating through the peripheral wall.

6. The machine of claim 5, wherein the oil passage comprises a bore hole in the bottom of the body of the adjustment part located near the axis.

7. The machine of claim 6, wherein the bore hole in the body of the adjustment part comprises a tube extending obliquely and generally radially upwardly and toward the axis.

8. The machine of claim 3, wherein the axis is at least approximately vertical; the concave side of the adjustment part opening toward the bottom of the housing; the rim of the adjustment part including a peripheral wall extending downwardly in the housing and the peripheral wall defining the bottom of the groove; the oil outlets communicating through the peripheral wall.

9. The machine of claim 8, further comprising a second annular wall coaxial with and radially inwardly spaced from the peripheral wall; the second wall extending up from the bottom of the housing and terminating below the concave side of the adjustment part, and also widening conically upward;

at least one tube located at the bottom of the second wall and communicating radially between the space inside the second wall and the space between the second wall and the peripheral wall.

10. The machine of claim 8, further comprising an additional annular wall section supported below the peripheral wall and tapering conically narrower toward the bottom of the housing; the additional wall having an opening through the bottom thereof.

11. The machine of claim 10, further comprising a second annular wall coaxial with and radially inwardly spaced from the peripheral wall and inside the additional wall; the second wall extending up from the bottom of the housing and terminating below the concave side of the adjustment part, and also widening conically upward;

at least one tube located at the bottom of the second wall and communicating radially between the space inside the second wall and the space between the second wall, on the one hand, and the peripheral and additional walls, on the other hand.

12. The machine of claim 1, wherein the swing lever pin includes a support surface thereon at the radially outward side of the slide block for supporting the slide block on the swing lever pin;

a friction reducing disk disposed between the slide block and the swing lever pin at the radially outward side of the slide block; the disk further sealing the space between the slide block and the swing lever pin for preventing oil flow past the disk and from between the slide block and the swing lever pin.

* * * * *